US010616674B2

(12) United States Patent
Schmitt et al.

(10) Patent No.: US 10,616,674 B2
(45) Date of Patent: Apr. 7, 2020

(54) HOUSING

(71) Applicant: INEAR GMBH & CO. KG

(72) Inventors: Andreas Schmitt, Reinheim (DE); Miriam Schmitt, Reinheim (DE)

(73) Assignee: INEAR GMBH & CO. KG, Dieburg (DE)

( * ) Notice: Subject to any disclaimer, the term of this patent is extended or adjusted under 35 U.S.C. 154(b) by 0 days.

(21) Appl. No.: 16/095,468

(22) PCT Filed: Apr. 13, 2017

(86) PCT No.: PCT/EP2017/059013

§ 371 (c)(1),
(2) Date: Dec. 26, 2018

(87) PCT Pub. No.: WO2017/182394

PCT Pub. Date: Oct. 26, 2017

(65) Prior Publication Data

US 2019/0149905 A1 May 16, 2019

(30) Foreign Application Priority Data

Apr. 22, 2016 (DE) ..... 10 2016 107 555
Sep. 23, 2016 (DE) ..... 20 2016 105 328 U

(51) Int. Cl.
*H04R 25/00* (2006.01)
*H04R 1/10* (2006.01)

(52) U.S. Cl.
CPC ..... *H04R 1/1016* (2013.01); *H04R 1/1083* (2013.01); *H04R 1/1091* (2013.01); *H04R 25/60* (2013.01); *H04R 25/652* (2013.01); *H04R 25/658* (2013.01); *H04R 2205/022* (2013.01)

(58) Field of Classification Search
CPC .... H04R 1/1016; H04R 1/1083; H04R 25/60; H04R 25/652; H04R 1/1091; H04R 25/658; H04R 2205/022
See application file for complete search history.

(56) References Cited

U.S. PATENT DOCUMENTS 7,016,512 B1 * 3/2006 Feeley ..... H04R 1/10 381/324
7,263,195 B2 * 8/2007 Harvey ..... H04R 1/1016 381/328
9,271,093 B2 * 2/2016 Goly ..... H04R 25/60

FOREIGN PATENT DOCUMENTS

EP 0147940 A1 7/1985
EP 2723100 A1 4/2014
WO 2015139749 A1 9/2015

OTHER PUBLICATIONS

International Search Repot (dated Aug. 4, 2017) for corresponding International App. PCT/EP2017/059013.

* cited by examiner

*Primary Examiner* — Brian Ensey
(74) *Attorney, Agent, or Firm* — WRB-IP LLP

(57) ABSTRACT

A housing is provided for an acoustic device which is worn in the ear. The housing includes two housing shells, which can be connected with one another along a housing connecting line. The housing connecting line extends at most sectionally in one plane. The housing connecting line is predefined such that the housing shells are configured without undercuts. An outer shape of the housing is adapted to a human ear shape such that the housing lies form-fittingly on an inner side of a tragus and on an inner side of a counter-ledge or antihelix of a human auricle, if the housing is arranged in the auricle.

17 Claims, 5 Drawing Sheets

HOUSING

BACKGROUND AND SUMMARY

The invention relates to a housing of an acoustic device, which is worn in the ear, wherein the housing comprises two housing shells, which can be connected to one another along a housing connecting line.

Such housings are, inter alia, used for headphones, ear protection, and hearing aids. The housings are here configured such that the housings can be inserted into an auricle of a person as well as possible, so that, if possible, no pain is caused by the housing, and the housing is secured to the auricle in as captive a manner as possible. For this purpose, housings anatomically adapted to the auricle are also known from the prior art, which housings lie on the auricle particularly well and engage form-fittingly with the auricle. Aside from the force-fitting connections between an earpiece out of foam material and/or silicone and an ear canal of the person, known from conventional in-ear phones, the captivity is significantly increased through the form-fitting connection.

For the assembly of the electronic components, required for the acoustic device, within the housing, the housings known from the prior art are configured in two parts. Usually, the housings are configured in two housing shells, divided along a connecting line extending in one plane.

Due to the complex outer shape of the housings adapted to the anatomy of the ear, the housings are usually produced in printing processes, for example through stereolithography. The printing technique is in particular also suitable for production of individualized housings that is, respectively adapted to the anatomy of a certain auricle of a person.

It is desirable to further develop the housings known from the prior art in order to make a simpler and more cost-effective production of housings possible.

According to an aspect of the invention, the housing connecting line extends in one plane, at most in sections. Usually the connecting line extends in a plane. Undercuts of the housing shells, in anatomically-adapted housings, are thereby unavoidable. Through the usage of a connecting line not extending in one plane, these undercuts can be avoided.

In a particularly advantageous configuration of the housing according to an aspect of the invention, it is provided that the housing connecting line is specified such that the housing shells are configured free of undercuts. The housing shells can thereby be produced in an injection-molding process, for example.

Advantageously, a shape of the housing is adapted to an auricle. According to an aspect of the invention, it is advantageously provided that the shape of the housing is specified such that the housing lies particularly well on auricle of a plurality of different persons and can be brought into engagement form-fittingly with the auricle. For this purpose, it is possible, for example that the shape of the housing corresponds to an average shape, wherein the average shape is established from the comparison of a plurality of housings adapted, in an individualized manner, to an individual auricle.

According to an aspect of the invention, it is advantageously provided that an outer shape of the housing is adapted to a human ear shape such that the housing lies form-fittingly on an inner side of a tragus and on an inner side of a counter-ledge or antihelix if the housing is arranged in an auricle of a human ear as intended. In this way, a particularly good seating of the housing in the auricle can be achieved.

In order to be able to simply join the housing shells, it can be provided according to an aspect of the invention that the housing connecting line is configured such that the housing shells can be joined, without undercuts, along the housing connecting line.

According to an aspect of the invention, it is advantageously provided that the housing is formed from two housing shells. Through the usage of merely two housing shells or a housing configured in two parts, the production costs can be further lowered, and the aesthetic overall impression of the housing can be improved by the avoidance of unnecessary joining points.

In a particularly advantageous configuration of the housing according to an aspect of the invention, it is provided that a curvature of the housing connecting line constantly changes, in sections. Through a constant changing of the curvature, almost any housing shell outer shapes of the housing shells can be provided and be produced, for example in the injection-molding process, without undercuts.

According to an aspect of the invention, the freedom of design for the housing shells outer shapes can be further increased in that the curvature of the housing connecting line constantly changes.

Advantageously, it is provided according to an aspect of the invention that the curvature of the housing connecting line is, in sections, zero in the region of a plug recess. In this way, the plug recess can advantageously be designed in a quadrate manner.

The configurative freedom can, in the usage of a plug recess adjoining the housing connecting line, be further increased in that the curvature of the housing connecting line, in the region of the plug recess, is, in sections, zero, and constantly changes in the remaining extension.

Advantageously, it is provided according to an aspect of the invention that the housing shells are an inner housing shell and an outer housing shell, wherein the inner housing shell is facing an ear canal, and the outer housing shell is visible, at least in sections, from outside if the housing is arranged in the auricle, wherein the outer housing shell, in a region visible from outside, has a planar shape. The region visible from outside in this case describes that region of the acoustic device, which, when seeing the auricle, is visible if the device is arranged in the auricle.

According to an aspect of the invention, the flat, visible region can be printed on, on an outer surface of the housing in order to achieve a design of the housing which is as appealing as possible. In addition, the planar shape of the region allows a simple assembly of the electronic components in the interior of the outer housing shell.

Advantageously, it is provided, according to an aspect of the invention that the outer housing shell comprises the plug recess adjacent to the connecting line. According to an aspect of the invention, a connector plug can, through the plug recess, be connected with a socket arranged within the housing and accessible via the plug recess. The connector plug can serve for the supply of electric energy and/or transmit tone information. The recess is advantageously configured in a quadrate manner.

According to an aspect of the invention it is provided that the housing shells have different colors, in order to further improve the optical overall impression of the housing.

In order to be able to arrange individual components of the acoustic device, outside of the housing and in the region of the ear canal, when used as intended, it can be provided, according to an aspect of the invention that the inner housing shell comprises a recess, which faces the ear canal when used as intended.

Advantageously, an adaptor is provided on the recess.

This adaptor extends out of the inner housing shell in the direction of the ear canal. The adaptor can be configured, according to an aspect of the invention, such that it is suited for the placement of an earplug. This can be a so-called standard-lamella. The adaptor is of hollow design and advantageously has an approximately cylindrical shape.

The adaptor and the inner housing shell can be configured in one piece. The adaptor is then stably connected with the inner housing shell, and the manufacture of the combination component out of inner housing shell and adaptor is particularly easy to accomplish.

Alternatively, the adaptor can be configured in two pieces. In this case, the adaptor allows itself to be inserted into the inner housing shell in a simple manner. Designs are hereby possible, in which the adaptor can be introduced into the inner housing shell from inside or from outside.

A two-part configuration of the adaptor in particular offers the advantage that the adaptor piece can be easily changed. This can, for example, be necessary in case the adaptor has become too strongly soiled by sweat or cerumen. Moreover, an earpiece fastened onto the adaptor can, in a simple fashion, also be replaced through replacing of the adaptor.

In a two-part configuration of the adaptor, a particularly simple production also of the adaptor is possible, in particular in an injection-molding process, since, in the suitable selection of a sectional line of the adaptor configured in two parts, two adaptor halves free of undercuts can be simply produced and, in assembly, can be joined to the adaptors. Advantageously, the section line or a sectional plane of the adaptor extends in an axial direction of the adaptor. The axial direction extends along a cavity surrounded by the adaptor.

It is, however, also possible and provided according to an aspect of the invention to configure the adaptor in three parts. In the three-part embodiment, the adaptor advantageously comprises a tubular middle piece, the outer circumference of which is adapted to a circumference of the recess of the inner housing shell. In order to fasten the adaptor in the recess to the inner housing shell, the adaptor comprises, according to an aspect of the invention, bearing elements, arranged on opposite-lying ends of the middle piece and comprising a larger outside circumference than the middle piece, wherein the bearing elements rest against opposite-lying lateral surfaces of the inner housing shell. Advantageously, to arrange the adaptor on the inner housing shell, the middle piece is initially arranged in the recess, and subsequently, the middle piece is fastened, through arrangement of the bearing elements on the ends of the middle piece, in the recess. The bearing elements can advantageously be bonded or welded to the middle piece.

It is particularly advantageous if the adaptor can be fixed to the inner housing shell. According to a possible embodiment, the adaptor can, through strong pressing into the recess, be releasably fixed in this recess. Moreover, it is possible to non-releasably fix the adaptor, by means of a bonding material, in the recess. According to a particularly advantageous embodiment, the adaptor is, from the direction of the inner side of the inner housing shell, guided through the recess and is fixed onto the side facing the ear canal during intended use in the recess through a ring. This embodiment offers the advantage that the adaptor sits very securely in the recess, but the fixing, through the removal of the ring, can nonetheless be released in a very simple manner.

It is preferred if the adaptor comprises at least one sound channel. The sound channel serves to conduct audio signals generated in the interior of the housing to the ear canal. It is very particularly preferred if the adaptor comprises an outer sound channel on its end oriented toward the ear canal in the intended use, which outer sound channel opens into at least two sound channels in the interior of the adaptor, which channels emerge out of the end of the adaptor facing the inner side of the housing when used as intended. Multiple sound channels are thus merged on the side of the user into one sound channel.

In an acoustic device, often times multiple audio drivers provided, which are optimized for different frequency ranges. This leads to an improved sound quality. The sound signals generated by the different audio drivers can be separately conducted to the adaptor, and subsequently combined in this adaptor. This results in a particularly brilliant sound pattern.

The invention, according to an aspect thereof, further includes an acoustic device with an audio-transducer in a housing. Here, the housing is preferably configured according to the embodiment described in greater detail above. The audio-transducer is a component which is configured to receive audio signals and to reproduce these.

To that end, preferably at least one audio driver is present in the audio-transducer. The audio driver transforms electrical signals into sound signals. Preferably, a one- or multi-way system is provided in the audio-transducer. In this case, multiple audio drivers are located in the audio-transducer, which audio drivers are specifically designed for the reproduction of different frequency bands. This results in a particularly good audio reproduction.

It is very particularly preferred if an audio-transducer according to an aspect of the invention, with multi-way system is employed with an adaptor, which adaptor comprises multiple sound channels. Here, the outputs of the different audio drivers are meant to be connected with the inner sound channels of the adaptor. The different sound signals which are emitted by the audio drivers are combined inside the adaptor. A particularly good output audio signal results.

In the acoustic device, a replaceable, passive noise filter can be provided. Such a noise filter offers an additional protection against external sound influences. The acoustic device be present in different embodiments. It can therefore be employed as a hearing device, in which the audio-transducer transforms sound signals into electrical signals, enhances these signals, and emits them via at least one audio driver. The acoustic device can, however, also be configured as a monitoring system for musicians. In this case, the audio-transducer receives sound signals in electrical form via a cable or by radio. The signals are amplified and are emitted via at least one audio driver. It is hereby particularly preferred if a one- or multi-way system comes to be employed. Moreover, the employment of the hearing device as a wireless component of a Bluetooth headset or as a cable-based component of a radio device is also possible.

BRIEF DESCRIPTION OF THE DRAWINGS

Further advantageous configurations of the housing according to aspects of the invention are explained in greater detail based on the exemplary embodiments represented in the drawings.

Shown are in.

DETAILED DESCRIPTION

Figure 1:
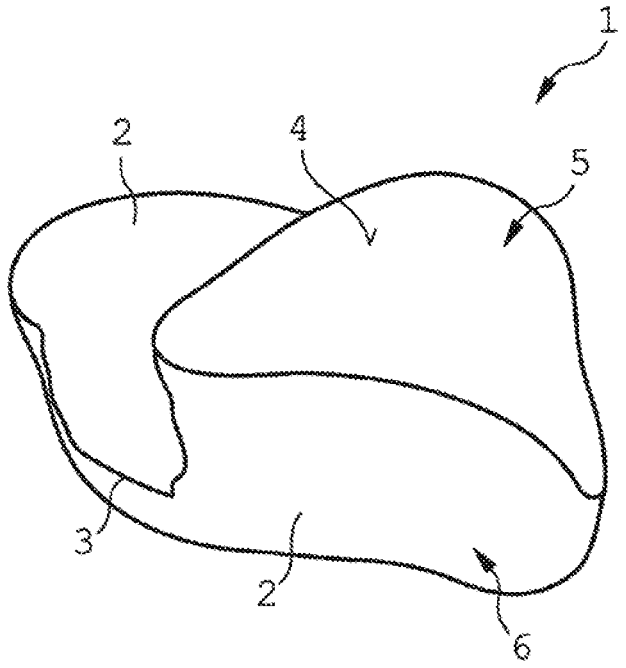
FIGS. 1 to 3 different schematically-illustrated views of a housing according to an aspect of the invention, FIGS. 4 to 7 different schematically-illustrated views of a housing according to an aspect of the invention, wherein the housing shells have different colors, FIG. 8 a schematic view of a housing according to an aspect of the invention with an adaptor, and FIG. 9 a schematic view of the adaptor.
Figure 2:
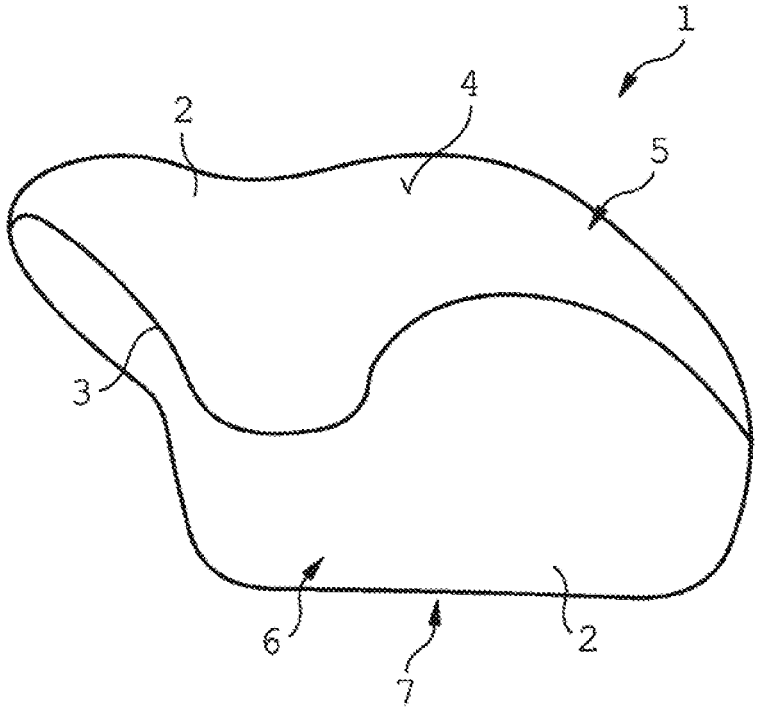
Figure 3:
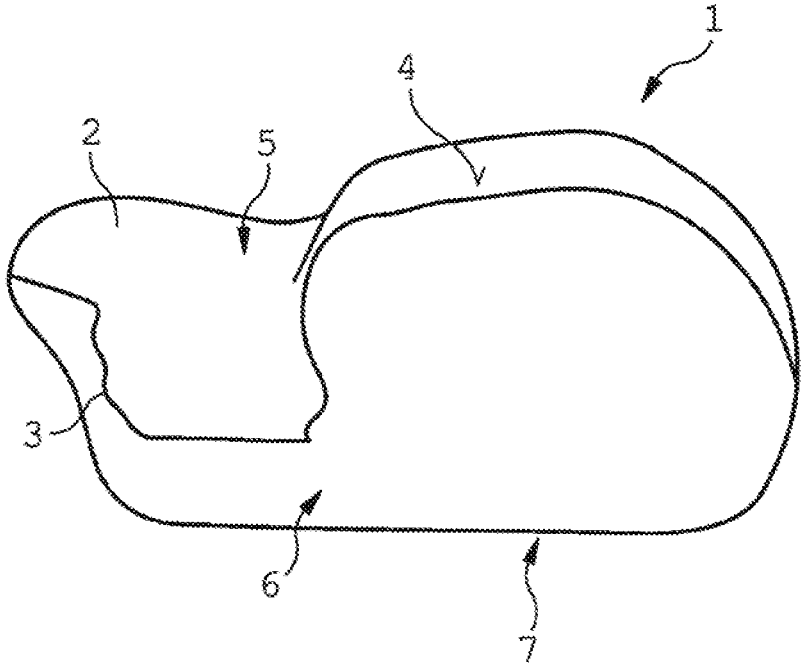
Figure 4:
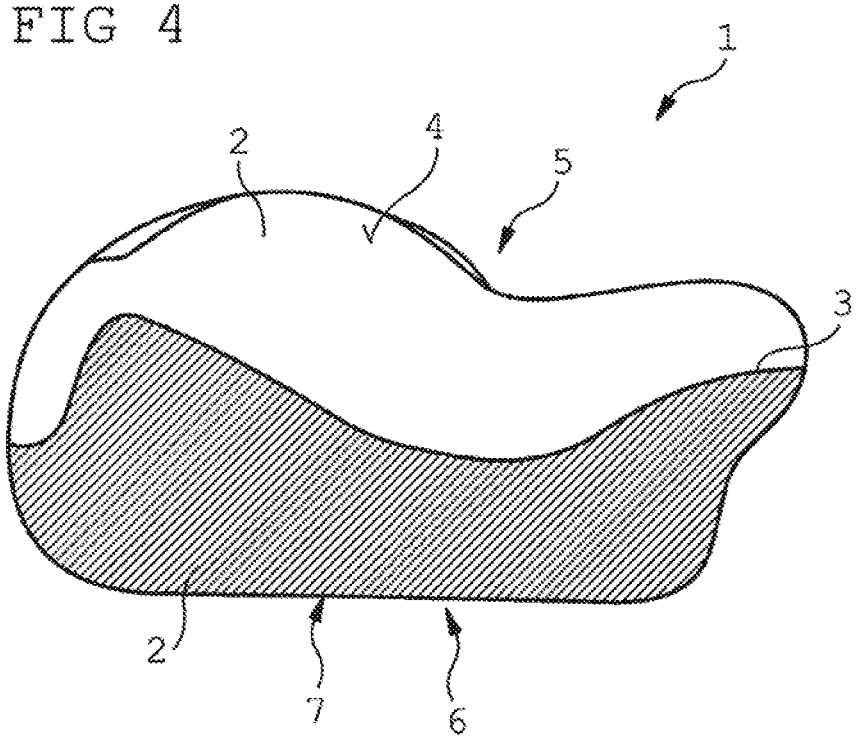
Figure 5:
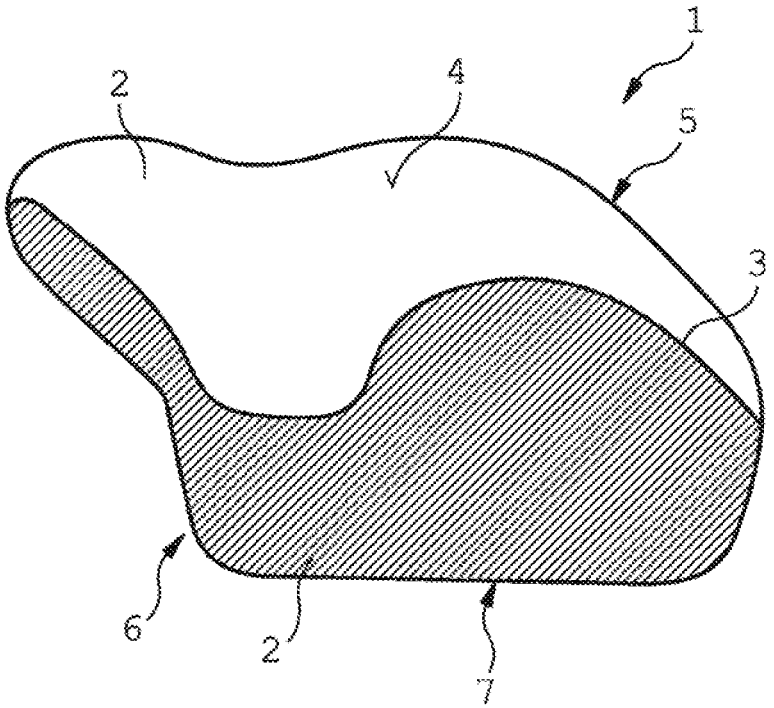
Figure 6:
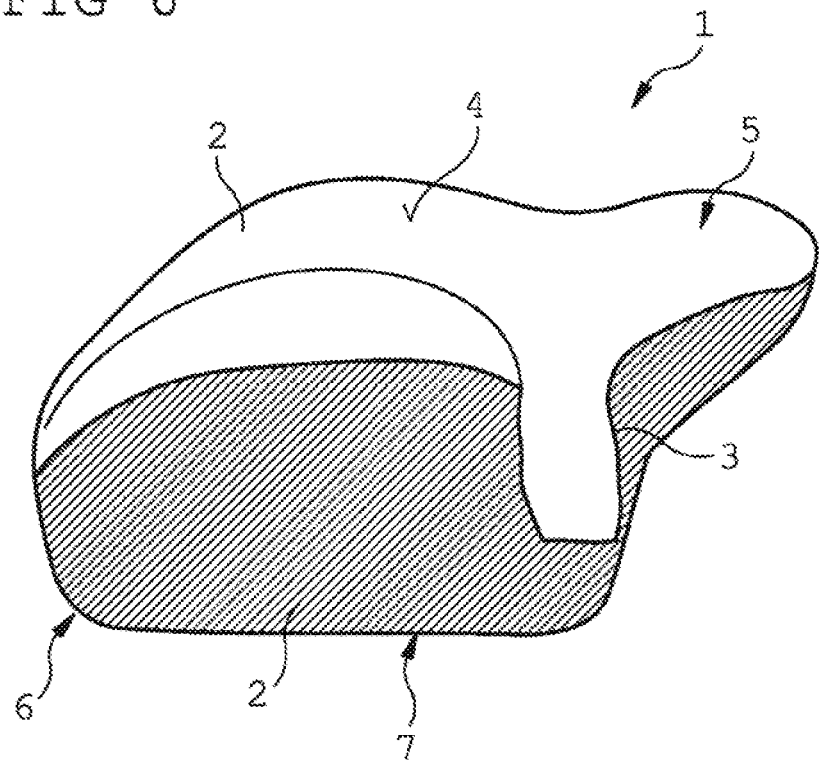
Figure 7:
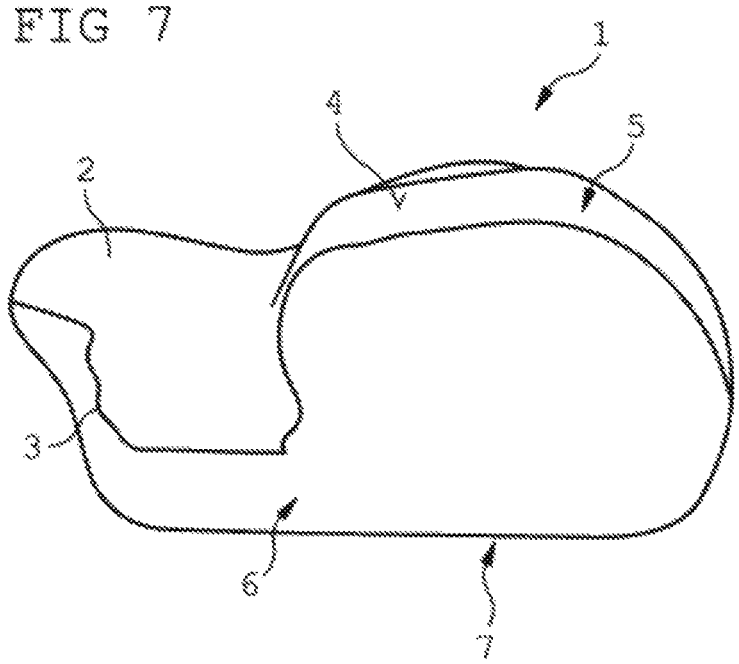

FIGS. 1 to 3 show different schematically-illustrated views of a housing (1) with two housing shells (2), which are connected with one another along a housing connecting line (3). The housing connecting line (3) does not extend in one plane, so that the housing shells (2) can be joined together without undercuts along the housing connecting line (3).

An outer shape (4) of the housing (1) is adapted to a human ear shape such that the housing (1) can be arranged form-fittingly in a non-illustrated auricle of a human ear. In this way, the wearing comfort of the housing can be significantly improved.

The housing shells (2) are an inner housing shell (5) and an outer housing shell (6). The inner housing shell (5) is facing a non-illustrated ear canal, and the outer housing shell (6) is at least in sections visible from outside if the housing (1) is arranged in the auricle. The outer housing shell (6) has a planar shape in a region (7) visible from outside. An individual imprint can, for example, be applied onto this region (7).

In the housing (1) schematically represented in FIGS. 4 to 7 in different views, the housing shells (2) have different colors.

Figure 8:
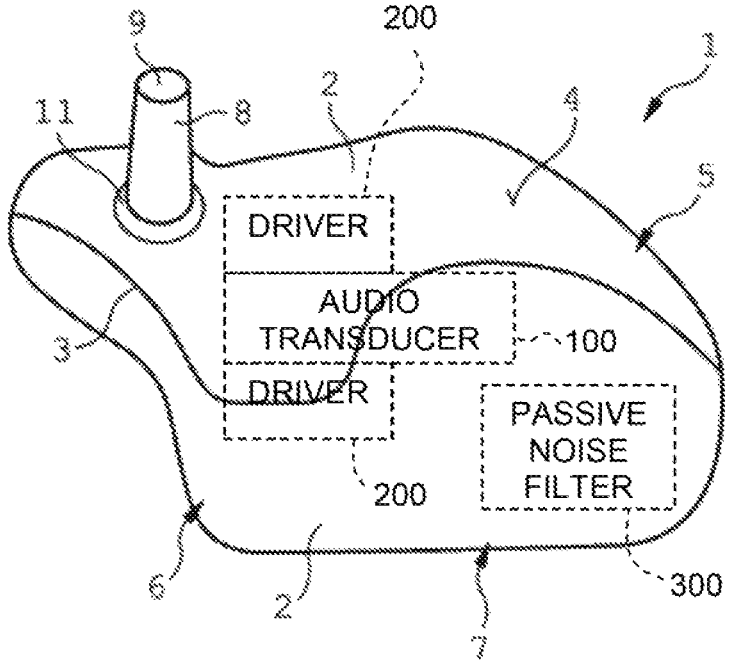

FIG. 8 shows an embodiment of the housing (1) with an adaptor (8). The adaptor (8) and the inner housing shell (5) are configured in two parts here. In order to fix the adaptor (8) in the inner housing shell (5), this adaptor is enclosed by a retaining ring (11). It is thereby avoided that the adaptor (8) unintendedly slips into the housing (1). The adaptor (8) serves for the transmission of sound into the ear canal. To that end, an outer sound channel (10), which can be discerned on the adaptor (8), is provided.

Figure 9:
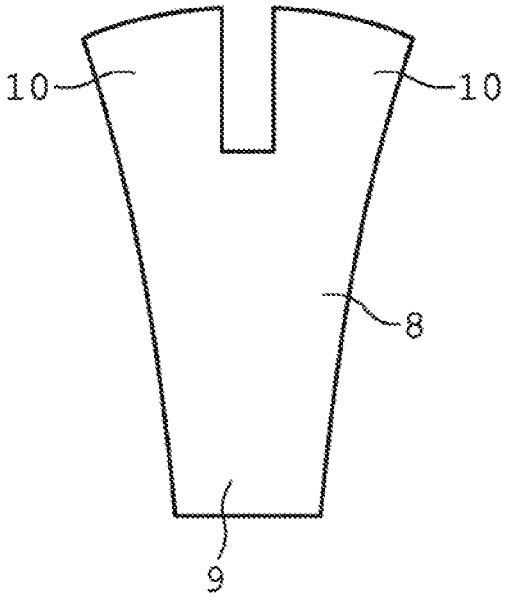

FIG. 9 shows the adaptor (8) in a schematic view. The adaptor (8) has an outer noise channel (9), which guides the noise generated by an audio-transducer, not shown, into the ear canal. The sound is initially received by two inner sound channels (10). These channels are connected, in the interior of the housing (1), with an audio-transducer (100). Two audio drivers (200) are provided on the audio-transducer (100), which audio drivers constitute separate sound sources as seen schematically in FIG. 8. The sound generated by the two audio drivers is separately supplied to the inner sound channels (10) and is merged in the outer sound channel (9). By virtue of the fact that the adaptor (8) is wider in the region of the inner sound channel (10) than in the region of the outer sound channel (9), it can not slip out of the inner housing shell (5) in the direction of the ear canal. In order to prevent a slipping of the adaptor (8) into the housing, a retaining ring, not shown in FIG. 9, can be provided on the adaptor (8). As seen schematically in FIG. 8, a replaceable, passive noise filter (300) can also be provided in the housing (1) of the acoustic device.

The invention claimed is:

1. Housing for an acoustic device, which is worn in the ear, wherein the housing comprises two housing shells, which can be connected with one another along a housing connecting line, wherein the housing connecting line extends in one plane, at most in sections, wherein an outer shape of the housing is adapted to a human ear shape such that the housing lies form-fittingly on an inner side of a tragus, and on an inner side of a counter-ledge or antihelix of a human auricle, if the housing is arranged in the auricle as intended.

2. Housing according to claim 1, wherein the housing connecting line is specified such that the housing shells are configured without undercuts.

3. Housing according to claim 1, wherein the housing connecting line is configured such that the housing shells can be joined together, without undercuts, along the housing connecting line.

4. Housing according to claim 1, wherein a curvature of the housing connecting line constantly changes, in sections.

5. Housing according to claim 1, wherein the curvature of the housing connecting line constantly changes.

6. Housing according to claim 1, wherein the curvature of the housing connecting line, in at least one region, is, in sections, zero.

7. Housing according to claim 6, wherein the curvature of the housing connecting line, in the at least one region, is, in sections, zero, and constantly changes in the remaining extension.

8. Housing according to claim 1, wherein the housing shells are an inner housing shell and an outer housing shell, wherein the inner housing shell is facing an ear canal, and the outer housing shell is at least, in sections, visible from the outside if the housing is arranged in the auricle, wherein the outer housing shell has a planar shape in a region visible from outside.

9. Housing according to claim 8, wherein the outer housing shell comprises a plug recess adjacent to the connecting line.

10. Housing according to claim 8, wherein the inner housing shell comprises a recess facing the ear canal, when used as intended.

11. Housing according to claim 10, wherein an adaptor is arranged on the recess for the placement of an earpiece.

12. Housing according to claim 11, wherein the adaptor is configured in two pans.

13. Housing according to claim 11, wherein the housing includes a retaining ring, with which the adaptor is fixable to the inner housing shell.

14. Housing according to claim 11, wherein the adaptor comprises at least one sound channel.

15. Housing according to claim 14, wherein the adaptor comprises an outer sound channel on its end oriented toward the ear canal, when used as intended, which sound channel opens into at least two sound channels in the interior of the adaptor, which sound channels emerge out of the end of the adaptor facing towards the inner side of the housing in the intended use.

16. Acoustic device with an audio driver in a housing according to claim 1.

17. Acoustic device according to claim 16, wherein an exchangeable, passive noise filter is provided in the housing.

* * * * *